United States Patent [19]

Salmon et al.

[11] 4,449,685

[45] May 22, 1984

[54] COUPLING FOR INDUCING A CURRENT IN THE RAILS OF A RAILROAD TRACK

[75] Inventors: Jean P. Salmon, Aulnay sous Bois; Claude P. Theze, Montigny les Cormeilles, both of France

[73] Assignee: Jeumont Schneider Corporation, Puteaux, France

[21] Appl. No.: 277,853

[22] Filed: Jun. 26, 1981

[30] Foreign Application Priority Data

Jul. 7, 1980 [FR] France ..... 80 15045

[51] Int. Cl.[3] ..... B61L 27/00; H04B 5/00

[52] U.S. Cl. ..... 246/8; 246/63 R; 246/187 B; 246/194; 336/222; 340/47

[58] Field of Search ..... 238/14.05, 14.11, 14.14, 238/14.2, DIG. 1, 1, 14.1, 14.6; 191/29 R, 32, 10; 246/8, 167 M, 7, 2 F, 63 R, 63 C, 63 A, 187 B, 194; 104/290, 292, 295, 298, 299; 336/222; 178/43; 179/82; 340/38 L, 47

[56] References Cited

U.S. PATENT DOCUMENTS

| | | | |
|---|---|---|---|
| 330,605 | 11/1885 | McLaughlin | 191/29 DM |
| 353,789 | 12/1886 | Ives | 246/8 |
| 847,905 | 3/1907 | Chouteau | 191/29 |
| 874,411 | 12/1907 | Leblanc | 191/10 |
| 2,651,713 | 9/1953 | Florencourt | 246/8 |
| 3,290,626 | 12/1966 | Hafner | 246/8 |
| 3,585,505 | 6/1971 | Ogilvy | 179/82 |
| 3,636,508 | 1/1972 | Ogilvy et al. | 340/47 |

FOREIGN PATENT DOCUMENTS

| | | | |
|---|---|---|---|
| 2501583 | 7/1976 | Fed. Rep. of Germany | 179/82 |

*Primary Examiner*—Randolph Reese

*Attorney, Agent, or Firm*—Rines and Rines, Shapiro and Shapiro

[57] ABSTRACT

The purpose of the invention is to reduce the total power consumed by a coupling for inducing a high-frequency alternating current in the rails of a railroad track for the purpose of transmitting information to trains traveling along the track.

According to the invention, the coupling consists of two conductive coils made of a conductive strip attached to an insulating strip, the conductive strip being arrayed, in the portions of the coupling that are parallel to the rail, in a plane parallel to the sides of the central rib of the rail and on either side of it, the insulating strip separating the central rib of the rail from the conductive strip. The two coils are connected in such a way that the same current flows in the same direction through both.

6 Claims, 4 Drawing Figures

COUPLING FOR INDUCING A CURRENT IN THE RAILS OF A RAILROAD TRACK

The present invention concerns devices for transmitting information to a train moving along a track. More precisely, it concerns the use of a coupling for inducing a high-frequency alternating current in the two rails of a railroad track.

In general, couplings for inducing a current in rails consist of a coil of conducting wire arranged on the flange of the rails, at least in the portion of the coupling parallel to the rails. For example, such a coupling, located at one end of a block of track and forming a rectangle 12 meters in length, must induce a 35 kHz alternating current in a 500 meter long block, such that the short-circuit current at the other end of the block is always at least 100 mA. The total power consumed by such a coupling, when coupled to the infinite ballast of the track, is around 30 watts, owing to losses due in particular to the skin effect and losses in iron.

For this reason, the coupling must be supplied with a current of at least 8 amperes, and for this a relatively expensive generator is required.

An object of the present invention, therefore, is to provide a new and improved coupling for inducing a current in the rails of a railroad track that is not subject to the above-described disadvantages.

Other and further objects will be explained hereinafter and are most particularly delineated in the appended claims.

Another purpose of the present invention is to reduce the total power consumed by eliminating losses so that the coupling can be driven by an alternating current generator of simpler design.

According to the invention, in summary, the coupling comprise two conductive coils, each having a strip of conductive metal attached to a strip of insulating material. The conductive strips are located in the parts of the coupling that are arrayed parallel to a rail on either side of its central rib and in a plane parallel to the rib. The insulating strip separates the central rib of the rail from the conductive strip. The two coils are connected in such a way that the same current flows in the same direction on either side of each rail.

Figure 1:
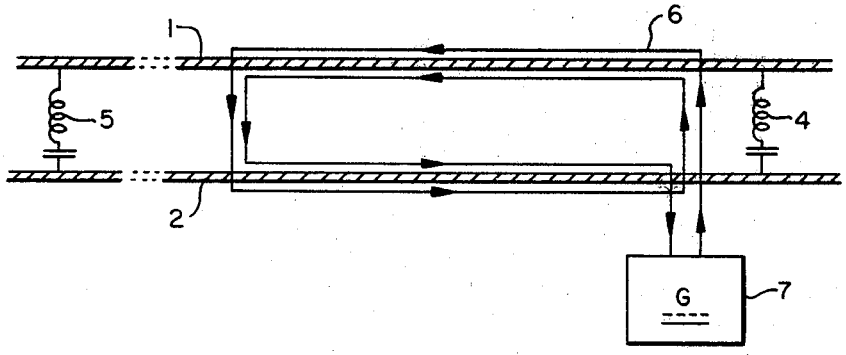

The invention will be understood more clearly, and other purposes, advantages, and characteristics will be more apparent, from the following descriptions which includes a preferred embodiment or best mode example. In the drawings, FIG. 1 is a schematic representation of a block of rail to be supplied with alternating current.

Figure 2:
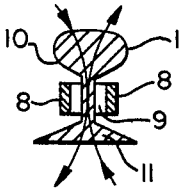
Figure 3:
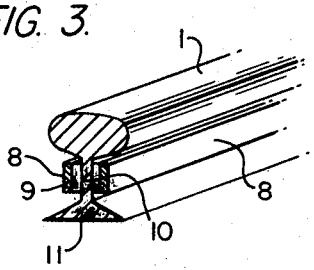
Figure 4:
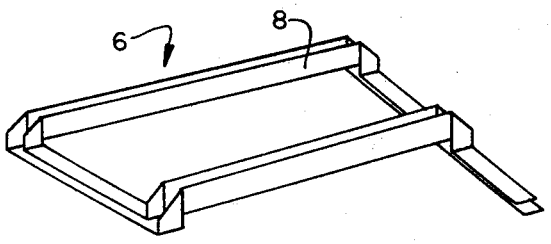

FIGS. 2 and 3 are, respectively, a cross-section and a perspective view of a rail equipped with two conductive strips forming a two-coil coupling, in keeping with the invention, and FIG. 4 is a perspective view in schematic form of the coupling itself.

Referring now to the figures, a block of track consists of a closed circuit made up of the two rails, 1 and 2, shunted at each end by tuned circuits 4 and 5, tuned to the frequency of the current induced by coupling 6. The coupling is connected to an alternating current generator, 7.

The coupling consists of two coils wound from a strip 8 of conductive material such as copper, of very small thickness compared with its length, and attached by means of a strip 9 of insulating material to either side of central vertical rib 10 of the rail, at least in the portions of the coupling arrayed parallel to the rail as shown in FIGS. 2 and 3, the width of the strip 8 is substantially greater than its thickness, and the portions of the coupling that are parallel to the rail comprise strip portions with the width arranged vertically in planes parallel to the central vertical rib 10 of the rail.

Each conductive strip 8 is therefore arrayed in a plane parallel to the walls of the central vertical rib 10 of the rail.

Thanks to this arrangement, the two coils can be connected in series in such a way that the current flows in the same direction in each part of the coupling. Accordingly, the fields generated in the rail by the two coils (see FIG. 2) practically cancel each other out in central vertical rib 10, which consitutes the narrow part of the rail. This makes it possible to reduce the iron losses in the rail for the same number of ampere-turns to half of the nominal current.

Finally, the use of a conductive strip makes it possible to eliminate the skin effect as well as losses due to proximity effects that cause substantial local modifications in the distribution of current within the conductor.

In a sample of the device, a conductive strip 5 cm in width of 0.2 mm thick was used. This was attached to an insulating strip of the same width by 18 mm thick (i.e., about 100 times greater than the thickness of the conductive strip), in order to limit the coupling, a source of iron losses, while remaining within the rail head structure, in such a way that the wheel of a train moving along the track will not slice through the coupling. In order to obtain 8 ampere-turns, a current of 4 amperes was used. The total power consumption was about 12 watts, an improvement of 60%, which made it possible to use an alternating current generator of very simple design and low-cost technology.

The conductive strips, 8, can be attached to the insulating material on either side of the rail by means of clamps, glue, etc.

The whole assembly, including conductor and insulating material, can be attached by means of insulated pads integrally attached to clamps attaching to horizontal rail flange 11.

Although only one form of the invention has been described, it is clear that the present invention applies equally to any modifications made by those skilled in this art and such are considered to fall within the spirit and scope of the invention as defined in the appended claims.

We claim:

1. A coupling for inducing a high-frequency alternating current in the two rails of a railway, each of said rails having a cross section approximating the form of a mushroom, in which a lower end of a central vertical rib is flattened to form a horizontal flange, and characterized by the fact that said coupling comprises two conducting coils, each having a strip of conductive material attached to a strip of insulating material, the strips of conductive material having portions that are arranged in planes parallel to the sides of the central vertical rib of each rail and on opposite sides of each rib, with said strip of insulating material having portions separating the central vertical rib from corresponding portions of the strip of conductive material, the strips having width that is substantially greater than the thickness thereof, and the width of said portions being arranged vertically.

2. A coupling as in claim 1 wherein the two conducting coils are connected in such a way that the same current flows through the coils in the same direction on either side of any one rail.

3. A coupling as in claim 1 wherein said strip of conductive material comprises a sheet of copper approximately 5 cm wide by 0.2 mm thick, while said strip of insulating material has a thickness one hundred times greater than that of the strip of conductive material.

4. A coupling for inducing a high-frequency alternating current in two rails of a block of railway track for transmitting information to a train moving along the track, the coupling comprising a pair of conducting coils, each conducting coil having first and second parallel portions adapted to extend along part of said block of railway track parallel to the rails thereof with the first portions of the conducting coils being disposed on opposite sides of a central vertical rib of one rail and the second portions of the conducting coils being disposed on opposite sides of a central vertical rib of another rail, each portion of the conducting coils being formed of a strip of conductive material attached to a strip of insulating material and being connected to its central vertical rib such that the strip of insulating material separates the strip of conductive material from the central vertical rib, the strips having width that is substantially greater than the thickness thereof, and the width being arranged vertically.

5. A coupling as in claim 4, further comprising a high-frequency alternating current generator connected to the conducting coils for inducing a high-frequency alternating current in the rails.

6. A coupling as in claim 4, wherein the two conducting coils are connected together such as the same current flows through both conducting coils and such that the current flow in the portions of the conducting coils disposed on opposite sides of a rail is in the same direction.

* * * * *